US006515214B2

(12) United States Patent
Takabayashi

(10) Patent No.: US 6,515,214 B2
(45) Date of Patent: Feb. 4, 2003

(54) PICKUP UNIT INCORPORATED IN STRINGED INSTRUMENT FOR CONVERTING VIBRATIONS OF STRING TO ELECTRIC SIGNAL IN GOOD FIDELITY

(75) Inventor: Yojiro Takabayashi, Shizuoka (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/125,892

(22) Filed: Apr. 19, 2002

(65) Prior Publication Data

US 2002/0157523 A1 Oct. 31, 2002

(30) Foreign Application Priority Data

Apr. 27, 2001 (JP) ..... 2001-132070
Sep. 21, 2001 (JP) ..... 2001-290047

(51) Int. Cl.[7] ..... G10H 3/18
(52) U.S. Cl. ..... 84/731; 84/743; 84/DIG. 24
(58) Field of Search ..... 84/723–746, DIG. 24

(56) References Cited

U.S. PATENT DOCUMENTS 2,222,057 A 11/1940 Benioff
3,453,920 A 7/1969 Scherer
4,860,625 A 8/1989 Mathews
4,867,027 A 9/1989 Barbera

*Primary Examiner*—Stanley J. Witkowski
(74) *Attorney, Agent, or Firm*—Morrison & Foerster LLP

(57) ABSTRACT

A pickup unit is used for converting vibrations of strings to electric signals for producing electric tones at good loudness, and the pickup unit includes a bridge assembly stationary to a body of the stringed instrument, vibration-responsive piezoelectric elements secured at the end portions thereof to the bridge assembly and vibration mediators held in contact with the strings and exerting force on the other end portions of the piezoelectric elements; since the vibration mediators have the freedom to move in the direction of the bending in the bridge assembly, the electric signals exactly represent the vibrations of the strings.

32 Claims, 15 Drawing Sheets

PICKUP UNIT INCORPORATED IN STRINGED INSTRUMENT FOR CONVERTING VIBRATIONS OF STRING TO ELECTRIC SIGNAL IN GOOD FIDELITY

FIELD OF THE INVENTION

This invention relates to an electric stringed musical instrument and, more particularly, to a pickup incorporated in the electric stringed musical instrument for converting vibrations of the string to an electric signal.

DESCRIPTION OF THE RELATED ART

Acoustic stringed musical instruments each have resonators. The violin, viola, cello and double-bass are categorized in the violin family, and the resonators are formed inside the bodies. While a musician is bowing a piece of music on the acoustic stringed musical instrument, the bow gives rise to vibrations in the strings for generating tones. The vibrations are propagated through a bridge to the resonator, and are magnified through the resonator. The vibrations in turn are propagated from the resonator to the air as the tones. Thus, the resonators are indispensable components of the acoustic stringed musical instruments.

On the other hand, the vibrations are electrically magnified in the electric stringed musical instruments. Several electric stringed musical instruments are, by way of example, sized like the members of the violin family, and are corresponding to the violin, viola, cello and double-bass. The electric stringed musical instrument corresponding to the violin is hereinbelow referred to as "electric violin". While a musician is playing a tune on the electric violin, the strings are bowed, and the bow gives rise to vibrations as similar to the acoustic stringed musical instrument as similar to the acoustic violin. However, the vibrations are converted to an electric signal, and the electric signals are amplified through a suitable amplifier for generating loud electric tones.

A pickup is provided for converting the vibrations to the electric signal. The pickup unit is implemented by a single piezoelectric element, which is provided under the bridge. The vibrations are provided from the four strings to the bridge, and the bridge exerts fluctuating pressure on the piezoelectric element. The piezoelectric element converts the fluctuating pressure to the electric signal. Thus, only one piezoelectric element is shared between the four strings.

The fundamental frequency in the four strings is varied in dependence on the tones to be generated. On the other hand, the piezoelectric element has own frequency characteristics. This means that the piezoelectric element can not evenly respond to the vibrations in all the strings. As a result, the electric tones are liable to be unbalanced.

A solution is proposed in U.S. Pat. No. 4,867,027 to Barbera. The U.S. Patent teaches a resonant pick-up system, which is incorporated in an electric stringed instrument. The prior art resonant pick-up system includes a transducer cartridge assembly upright on a body of the stringed instrument. The transducer cartridge assembly includes a cartridge body, which has an upper portion or crown portion and a lower portion or base portion. The crown portion is vibratory, but the base portion is non-vibratory. Slots and cavities are formed in the crown portion. The slots radially downward extend from the upper edge of the crown portion, and separate the crown portion into "vibrating supporting crown sections or segments". The cavities are formed in the vicinity of the bottom ends of the slots, and are radially elongated from the base portion into the segments. The segments are formed with shallow receiving grooves, and the shallow receiving grooves are open at the crown edges of the segments. The shallow receiving grooves are aligned with the center axes of the slots, respectively. The strings pass the shallow receiving grooves, and are held in contact with the upper surfaces of the segments.

In one embodiment disclosed in the U.S. Patent, piezoelectric elements are mounted within the cavities. Bimorph piezoelectric transducers are recommended in the U.S. Patent. Barbera describes the piezoelectric elements, "Thus, the piezo-elements are mounted along the longitudinal axis of its respective cavity so that one end is fixed to the vibrating portion of section and the other end is fixed to the lower non-vibrating stationary base portion."

Barbera further discloses another embodiment in the U.S. Patent for the cello or base. U-shaped recesses are formed in the cartridge base support. The U-shaped recesses make the upper portion of the cartridge base support into plural sections, which are merged into the rigid lower portion of the cartridge base support. Piezo-electric cartridges are provided in the U-shaped recesses. The piezo-electric cartridges are secured at the lower portions thereof to the walls defining the lower portions of the U-shaped recesses. As a result, each of the cartridge assemblies "provides a singular flexible upper portion above the notch which will vibrate freely with respect to the mass of the bridge and be free of interaction or interference with any of the other cartridges". A cavity is formed in the piezoelectric cartridge below the notch, and a piezoelectric element is located therein.

A problem is encountered in the prior art electric stringed musical instrument in that the electric signals, which are output from the piezoelectric elements, are too small in magnitude. This results in that pieces of music information are liable to be inaccurately transferred from the vibrations to the electric signals. As a result, the electric tones become different from the tones intended by the musician.

SUMMARY OF THE INVENTION

It is therefore an important object of the present invention to provide a pickup unit, which converts vibrations to electric signals at good fidelity.

The present inventor contemplated the problem inherent in the prior art resonant pickup system, and noticed that the vibrations were indirectly propagated from the strings to the piezoelectric elements through the segments, which were merged into the non-vibratory base portion or lower portion. This meant that the flexural rigidity was increased from the crown edges toward the non-vibratory base portion. Even though the vibrations were propagated from the strings to the crown edges of the segments, the vibrations were gradually decayed toward the non-vibratory base portion or lower portion, and, accordingly, only part of the vibration energy was propagated to the piezoelectric elements or piezoelectric cartridges. The present invention concluded that vibration mediators such as the vibratory segments were to be physically separated from any non-vibratory portion.

In accordance with one aspect of the present invention, there is provided a pickup unit for a stringed musical instrument comprising a stationary member attached to a body of the stringed musical instrument and having plural zones, plural transducers connected at certain portions thereof to the stationary member in the plural zones, respectively, and deformable in response to repeated forces respectively exerted thereon in certain directions for producing electric signals representative of the forces, and plural vibration mediators connected between strings of the stringed musical instrument and other portions of the plural transducers for transmitting the repeated forces from the strings to the plural transducers and having a freedom to move in at least the certain direction in the plural zones, respectively.

BRIEF DESCRIPTION OF THE DRAWINGS

The features and advantages of the pickup will be more clearly understood from the following description taken in conjunction with the accompanying drawings, in which.

DESCRIPTION OF THE PREFERRED EMBODIMENTS

First Embodiment

Figure 1:
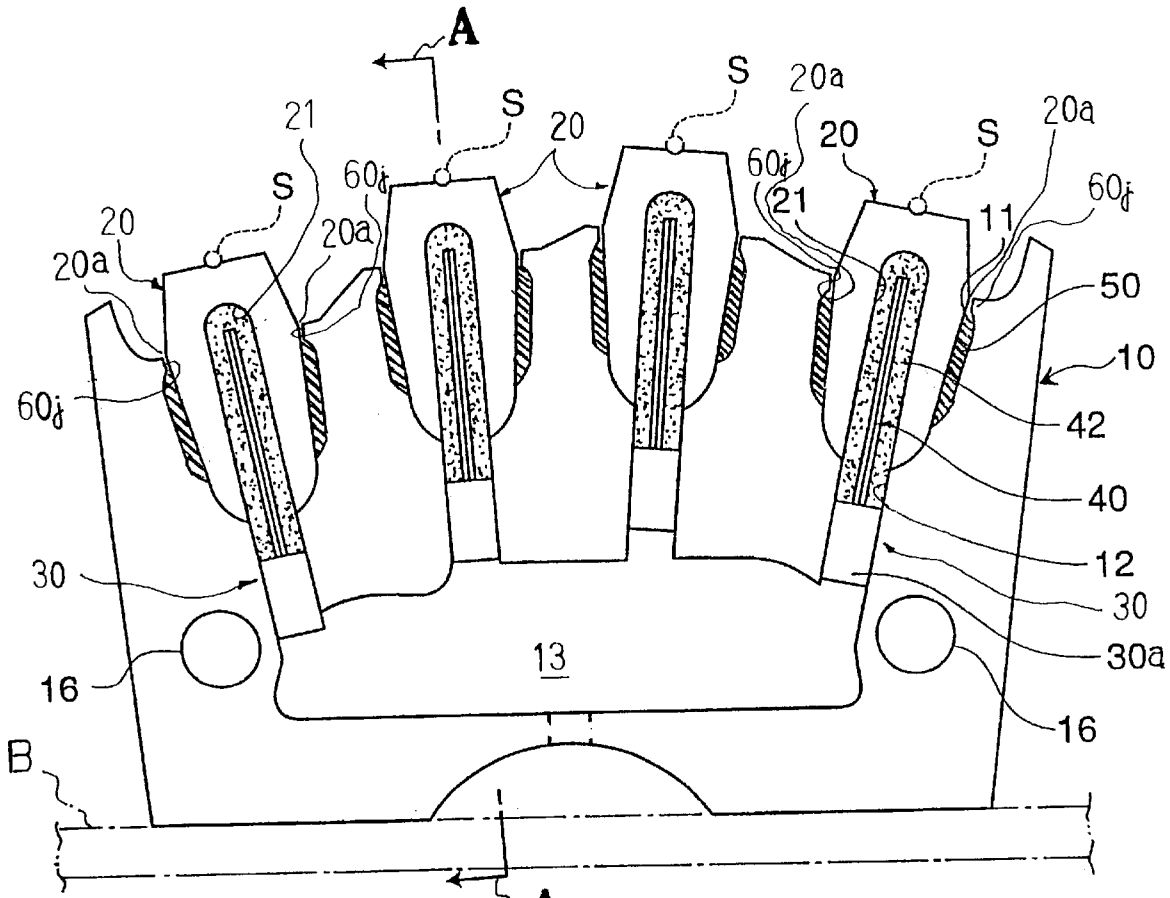
FIG. 1 is a front view showing the structure of a pickup unit according to the present invention.
Figure 2:
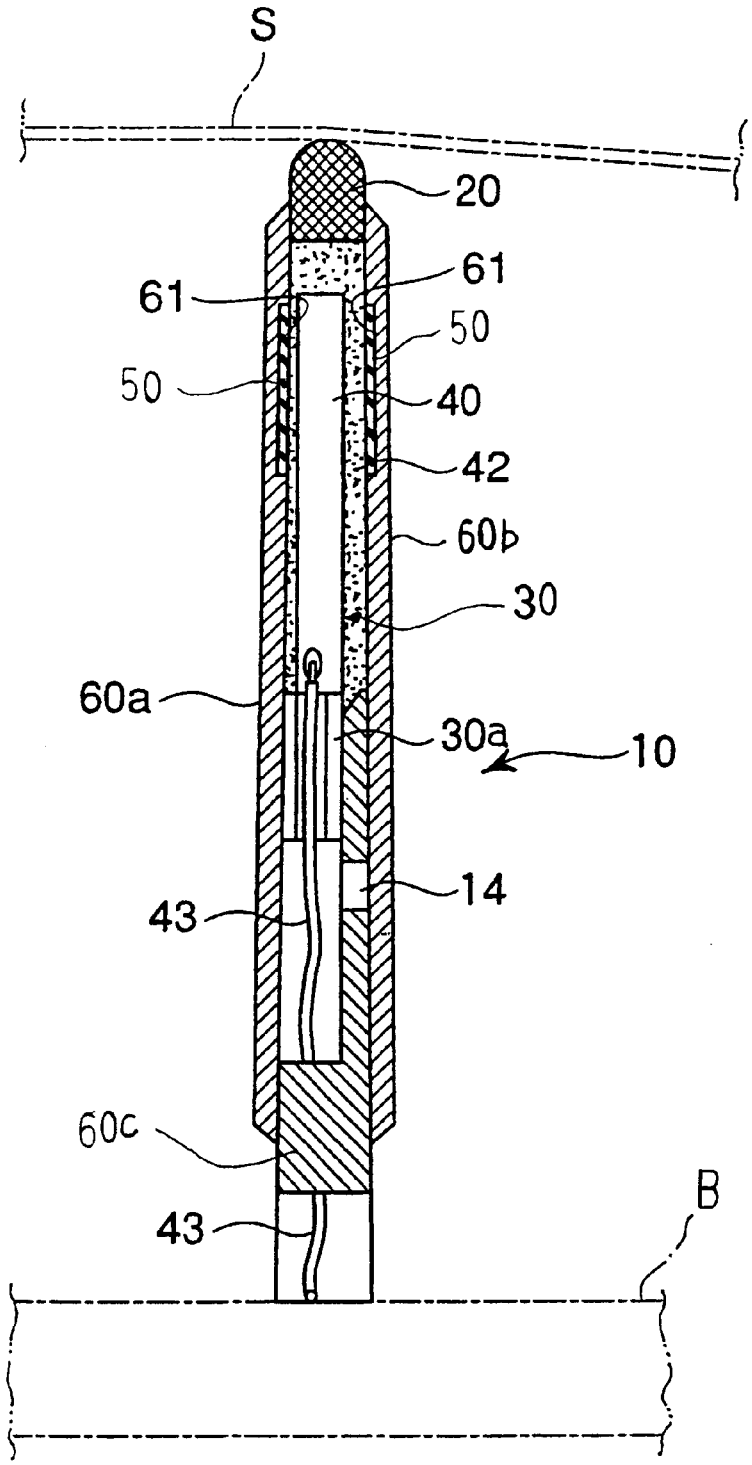
FIG. 2 is a cross sectional view taken along line A—A of FIG. 1 and showing the structure of the pickup.

Referring to FIGS. 1 and 2 of the drawings, a pickup unit embodying the present invention comprises a bridge assembly 10, vibration mediators 20, vibration-responsive transducer assemblies 30, pieces 42 of plastic substance and visco-elastic bodies 50. A cover plate is removed from the bridge assembly 10 in FIG. 1. The pickup forms a part of an electric violin, and is upright on a soundboard B of a violin. Strings S are stretched over the soundboard B in directions normal to the paper where the pickup is drawn.

The vibration-responsive transducer assemblies 30 are retained by the bridge assembly 30. The vibration mediators 20 are physically separated from the bridge assembly 10, and are coupled with the bridge assembly 10 by means of the visco-elastic bodies 50. The strings S are in contact with the vibration mediators 20, and the vibration mediators 20 are coupled with the vibration-responsive transducer assemblies 30 by means of the pieces 42 of plastic substance. Thus, the vibration mediators 20 are physically separated from the bridge assembly 10 so as to be freely vibratory without strong restriction.

The bridge assembly 10 has a configuration analogous to the bridge of an acoustic violin. The upper edge is gently curved like a crown, and the front and the bridge assembly 10 is slightly increased in width from the bottom edge to the upper edge. In this instance, the core plate 60*c* is sandwiched between the cover plates 60*a* and 60*b*. The cover plates 60*a*/60*b* prevent the vibration-responsive transducer assemblies 30 and leads from damages.

Figure 3:
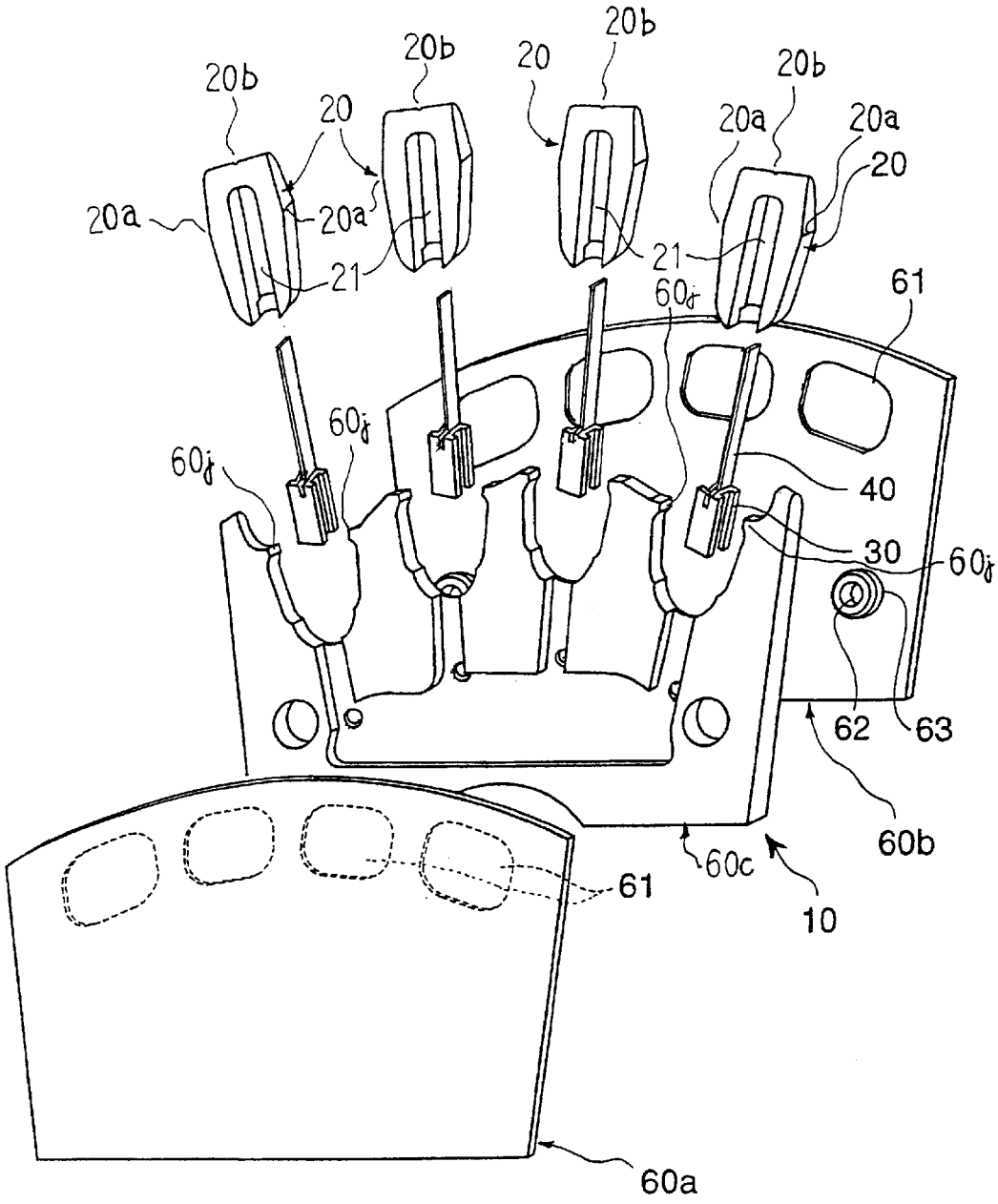
FIG. 3 is a fragmentary perspective view showing essential parts of the pickup unit.

As will be better seen in FIG. 3, a pair of cover plates 60*a*/60*b* and a core plate 60*c* constitute the bridge assembly 10. The cover plate 60*a* is formed with four recesses 61, which are arranged along the crown edge of the cover plate 60*a*. Similarly, the other cover plate 60*b* is formed with the four recesses 61 arranged along the upper crown edge of the cover plate 60*b*, and the four recesses 61 in the cover plate 60*a* are aligned with the four recesses 61 in the other cover plate 60*b*, respectively.

Figure 4:
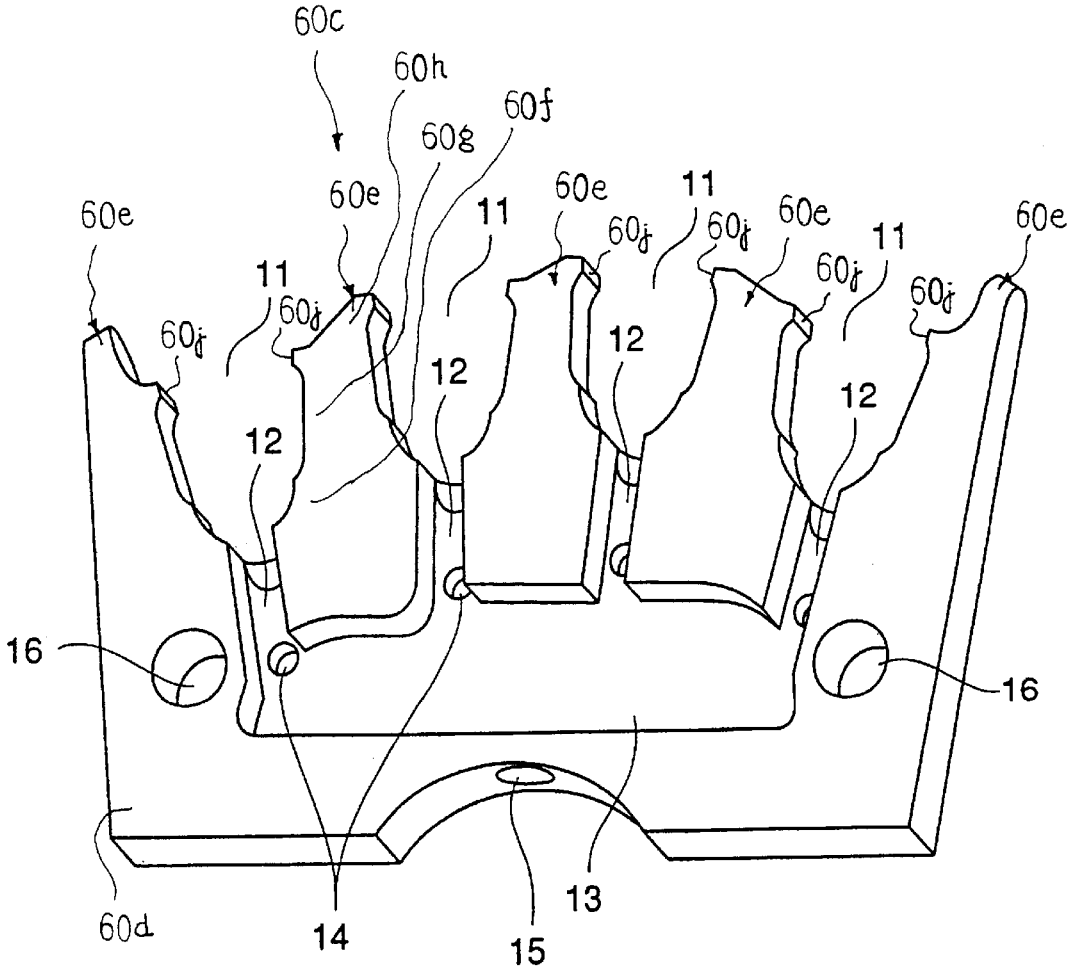
FIG. 4 is a perspective view showing the configuration of a core plate forming a part of the pickup unit.

The core plate 60*c* is like a hand as shown in FIG. 4, and has a palm portion 60*d* and fingers 60*e*. The fingers 60*e* project from the palm portion 60*d*, and are spaced from one another. Thus, a hollow space 11 takes place between the fingers 60*e* adjacent to each other. The core plate 60*c* is formed of wood. However, synthetic resin such as, for example, ABS or polycarbonate, metal or alloy is available for the core plate 60*c*.

The palm portion 60*d* is formed with a dent 13 under the central three fingers 60*e*. The dent 13 reduces the mass of the core plate 60*c*. The palm portion 60*d* is further formed with grooves 12, and the grooves 12 are open to the upper ends to the hollow spaces 11 and at the lower ends to the dent 13. Thus, the hollow spaces 11 are connected to the dent through the grooves 12. The dent 13 and grooves 12 make the palm portion 60*d* partially thin. Through-holes 14/15 and through-holes 16 are further formed in the palm portion 60*d*. The through-holes 14 extend in the direction of thickness of the palm portion 60*d*, and are open at the boundaries between the grooves 12 and the dent 13. The through-hole 15 vertically extends, and is connected between the dent 13 and a space defined by the arc surface of the core plate 60*c*. The through-holes 16 extend in the direction of the thickness, and are located on both sides of the dent 13.

The fingers 60*e* have respective bottom portions 60*f*, respective intermediate portions 60*g* and respective tip portions 60*h*. The bottom portion 60*f*, intermediate portion 60*g* and tip portion 60*h* of each finger 60*e* are respectively opposed to the bottom portion or portions 60*f*, intermediate portion or portions 60*g* and tip portion or portions 60*h* of the adjacent finger or fingers 60*e*, and, accordingly, the hollow space 11 is divided into a bottom sub-space, an intermediate sub-space and an open space. The bottom portions 60*f* have side surfaces, which are downwardly curved toward the bottom of the hollow space 11, and make the bottom sub-space like a parabola. The associated groove 12 is open at the vertex of the parabola sub-space. The intermediate portions 60*g* are constricted so as to have side surfaces spaced wider than the side surfaces of the bottom portions 60*p*. Thus, the intermediate sub-spaces are wider than the bottom sub-spaces.

The side surfaces of the intermediate portions 60*g* form projections 60*j* together with side surfaces of the tip portions 60*h*. The tip portions 60*e* define the upper sub-spaces open to the environmental space.

Turning back to FIGS. 1 to 3, the vibration mediators 20 are provided in the hollow spaces 11, and the strings S are in contact with the vibration mediators 20, respectively. The vibration mediators 20 are associated with the vibration-responsive transducer assemblies 30, respectively. The vibration-responsive transducer assemblies 30 are supported by the core plate 60*c*, and project into the associated vibration mediators 20. The pieces 42 of plastic substance fills the gap between the vibration mediators 20 and the vibration-responsive transducer assemblies 30, and the vibration mediators 20 are connected to the core plate 60*c* by means of the visco-elastic bodies 50. Thus, vibrations are propagated from the strings S to the vibration-responsive transducer assemblies 30 through the vibration mediators 20, which are physically separated from the core plate 60*c*.

Figure 5:
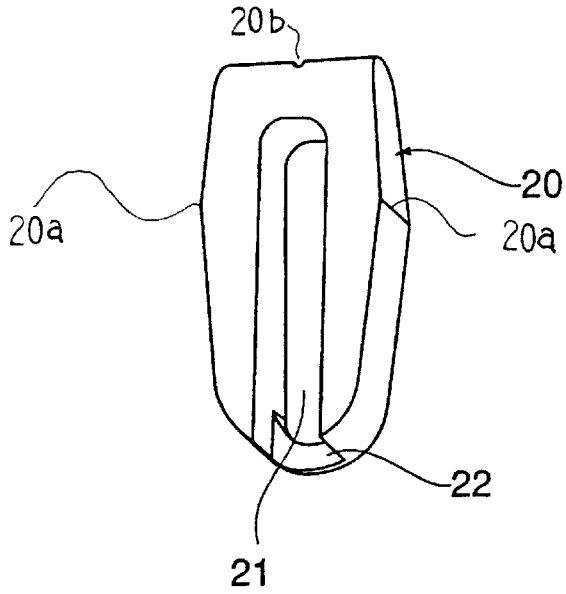
FIG. 5 is a perspective view showing the configuration of a vibration mediator incorporated in the pickup unit.

FIG. 5 shows one of the vibration mediators 20. The other vibration mediators 20 are similar in configuration to the vibration mediator 20 shown in FIG. 5. For this reason, only the vibration mediator 20 shown in FIG. 5 is described in detail. The vibration mediator 20 is formed with a slot 21. The slot 21 is elongated in the longitudinal direction, and makes the vibration mediator 20 bifurcate into two parts. The two parts are connected to each other by means of a bridge portion 22. The bridge portion 22 reinforces the mechanical strength of the two parts. However, the bridge portion 22 is thinner than the two parts. Thus, the slot 21 is open at the lower end of the vibration mediator 20 as well as the front/rear surfaces.

The vibration mediator 20 has an upper edge and two pairs of side surfaces, i. e., a pair of lower side surfaces and a pair of upper side surfaces. The lower side surfaces increase the width of the vibration mediator 20 from the lower end toward the upper side surfaces, and the upper side surfaces decrease the width from the upper edge toward the lower side surfaces. This means that the vibration mediator 20 is widest at the boundary between the lower side surfaces and the upper side surfaces. The lower side surfaces and the upper side surfaces form a pair of ridges 20*a*.

The lower side surfaces are curved so as to give a U-letter shape to the lower portion of the vibration mediator 20. The curved lower side surfaces are slidable on the side surfaces of the lower portions of the fingers 60*e*. As shown in FIG. 1, the vibration mediator 20 between the lower side surfaces and between the upper side surfaces is narrower than the intermediate sub-space and the upper sub-space of the associated hollow space 11. The projections 60*j* are spaced from the upper end of the groove 12 along the centerline of the hollow space 11 by a distance approximately equal to the distance along the centerline of the associated vibration mediator 20 between the opening of the slot 21 and the ridges 20*a*. When the lower portion of the vibration mediator 20 is received in the lower sub-space 11, the ridges 20*a* are opposed to the projections 60*j*, respectively. However, the projection 60*j* is spaced from the associated projection slightly wider than the distance between the ridges 20*a*. For this reason, extremely narrow gaps take place between the ridges 20*a* and the projections 60*j*. The lower portion of the vibration mediator 20 is not secured to the lower portions of the fingers 60*e* so that the vibration mediator 20 is movable in the lower sub-space about a virtual center of the curved surfaces. Notches 20*b* are formed in the upper edges of the vibration mediators 20, and the strings S are to be engaged with the notches 20*b*, respectively.

Figure 6:
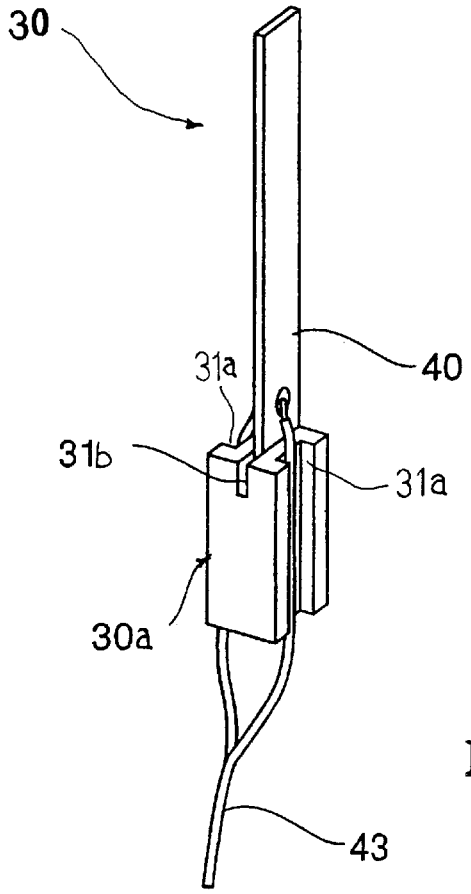
FIG. 6 is a perspective view showing the structure of a vibration-responsive transducer incorporated in the pickup unit.

The vibration-responsive transducer assemblies 30 are similar in configuration to one another, and are respectively assigned the grooves 12. One of the vibration-responsive transducer assemblies 30 is illustrated in FIG. 6, and description is hereinbelow made on the vibration-responsive transducer assembly 30 shown in FIG. 6, and description on the other vibration-transducer assemblies 30 is omitted for avoiding repetition.

The vibration-responsive transducer assembly 30 is broken down into a retainer 30*a* and a bimorph piezoelectric element 40. The retainer 30*a* has a generally rectangular parallelepiped configuration, and is formed of synthetic resin. A piece of wood, metal or alloy is available for the retainer 30*a*. The retainer 30*a* is as wide as the associated groove 12, and has thickness approximately equal to the depth of the associated groove 12. When the retainer 30*a* is pressed into the associated groove 12, the retainer 30*a* is snugly received into the associated groove 12, and has the front surface substantially coplanar with the surface of the palm portion 60*d* defining the periphery of the grooves 12.

The retainer 30*a* is formed with a pair of grooves 31*a* and a slit 31*b*. The pair of grooves 31*a* vertically extends, and is open at the side surfaces of the retainer 30*a*. A pair of leads 43 passes through the grooves 31*a*. The slit 31*b* is open at the upper surface of the retainer 30*a*, and the width of the slit 31*b* is approximately equal to the thickness of the bimorph piezoelectric element 40. The bimorph piezoelectric element 40 is adhered to the inner surfaces of the retainer 30*a* by means of adhesive compound. Thus, the bimorph piezoelectric element 40 is secured to the retainer 30*a*, and is upright thereon.

A pair of piezoelectric crystal plates constitutes the bimorph piezoelectric element 40. The piezoelectric crystal plates are joined together in such a manner that the polarization causes the piezoelectric crystal plates to be oppositely charged. In this instance, the crystal orientation is adjusted in such a manner that the polarization is opposite between the piezoelectric crystal plates in the direction of the thickness of the bimorph piezoelectric element 40, and, accordingly, current is taken out from the electrodes on the obverse and reverse surfaces of the bimorph piezoelectric element 40. If the crystal orientation is adjusted in such a manner as to have the polarization identical in the direction of the thickness, the current is taken out from the electrodes on the central portion and end portion of the bimorph piezoelectric element 40. The leads 43 are fixed to the electrodes on the piezoelectric crystal plates, respectively. The leads 43 pass through the hole 15, and taken out from the pickup unit.

Turning back to FIGS. 1 and 2, the retainers 30*a* are snugly received in the grooves 12, and the vibration mediators 20 are placed in the hollow spaces 11. Then, the bimorph piezoelectric elements 40 project into the slots 21 in the vibration mediators 20. The slots 21 are much wider than the bimorph piezoelectric elements 40, and, accordingly, gap takes place between the bimorph piezoelectric elements 40 and the inner surfaces of the vibration mediators 20 defining the slots 21. As described hereinbefore, most of the lower side surfaces and the upper side surfaces are spaced from the side surfaces of the finger portions 60*e*, gap also takes place between the finger portions 60*e* and the vibration mediators 20. The gap between the bimorph piezoelectric elements 40 and the vibration mediators 20 is filled with the pieces 42 of plastic substance, and the visco-elastic bodies 50 are provided between the finger portions 60*e* and the vibration mediators 20.

The pieces 42 of plastic substance propagate the cyclic force due to the vibrations from the vibration mediators 20 to the bimorph piezoelectric elements 40. While a piece 42 of plastic substance is propagating the cyclic force, the piece 42 of plastic substance diffuses the cyclic force from the associated vibration mediator 20 over the entire surfaces of the bimorph piezoelectric elements 40, and blocks the associated bimorph piezoelectric element 40 from the vibrations of the adjacent vibration mediators 20. Thus, each of the pieces of plastic substance serves as a filter as well as a diffuser.

In this instance, the plastic substance is fat clay. The hardness of the fat clay is to be appropriately regulated. If the hardness is too high, the pieces 42 of fat clay can not achieve the expected diffusion characteristics and expected filtering characteristics. On the other hand, if the hardness is too low, the pieces 42 of plastic substance can not give rise to the bending wide enough to flow a large amount of current.

The present inventor measured the hardness of plastic substance as follows. A piece of plastic substance was placed under a steel ball. The steel ball was 36 millimeters in diameter, and the weight was 200 grams. The steel ball was maintained at 50 centimeters high. The steel ball was released, and was dropped onto the piece of plastic substance. The steep ball sank into the piece of plastic substance. When the steel ball was removed from the piece of plastic substance, a dent was left in the piece of plastic substance. The diameter of the dent was inversely proportional to the hardness of the plastic substance. When the diameter of the dent was 28 millimeters, the hardness was ranked at "3". If the diameter was increased by 0.5 millimeter, the hardness was decreased by 0.1. On the contrary, if the diameter was decreased by 0.5 millimeter, the hardness was increased by 0.1. The present inventor determined the preferable range of the hardness through the above-described measurement. The preferable range was between 4.0 and 4.5.

The vibration mediators 20 are spaced from the finger portions 60*e*, and the gap permits the vibration mediators 20 to vibrate in the hollow spaces 11. The visco-elastic bodies 50 are provided in the gap between the finger portions 60*e* and the vibration mediators 20 and the shallow recesses 61 between the vibration mediators 20 and the cover plates 60*a*/60*b*. The visco-elastic bodies 50 give appropriate resistance against the vibrations, and prevent the vibration mediators 20 from violent shakes in the presence of weak vibrations. This results in that the bimorph piezoelectric elements 40 linearly vary the output signals. Thus, the visco-elastic bodies 50 are conducive to a preferable dynamic range for the output signals. From this point of view, the visco-elastic bodies 50 are expected to have resiliency and hardness like rubber. It is preferable to have the hardness between 11 and 30 by using the scale for the type-A hardness meter defined in JIS (Japanese Industrial Standards) K6253. Silicone sealant TSE397 or TSE399, which are manufactured by Toshiba Silicone Corporation, is available for the visco-elastic bodies 50. The visco-elastic bodies 50 may be replaced with pieces of rubber in so far as the rubber has the hardness fallen within the range.

The gap between the vibration mediator 20 and each finger portion 60*e* preferably ranges from 0.1 millimeter wide to 0.25 millimeter wide. If the gap is less than 0.1 millimeter, the vibration mediator 20 tends to be brought into collision with the side surface of the finger portion 60*e*. The vibration mediator 20 is undesirably restricted by the side surface, and the vibrations are inaccurately input to the associated bimorph piezoelectric element 40. On the other hand, if the gap is greater than 0.25 millimeter, the visco-elastic bodies 50 merely offer weak resistance against the vibrations, and the vibration mediator 20 is excessively driven for vibrations. The excess vibrations are causative of damages to the bimorph piezoelectric element 40.

The gap between the vibration mediator 20 and the finger portions 60*e* is required for the substantially rigid core plate 60*c*. However, the core plate 60*c* may be formed of resilient material. In this instance, the vibration mediators 20 may be received in hollow spaces 11 without any gap, because the core plate per se is resiliently deformed.

The core plate 60*c* is sandwiched between the cover plates 60*a* and 60*b*. In this instance, the cover plates 60*a*/60*b* are formed of synthetic resin. However, wood, metal or alloy is available for the cover plates 60*a*/60*b*.

Figure 7:
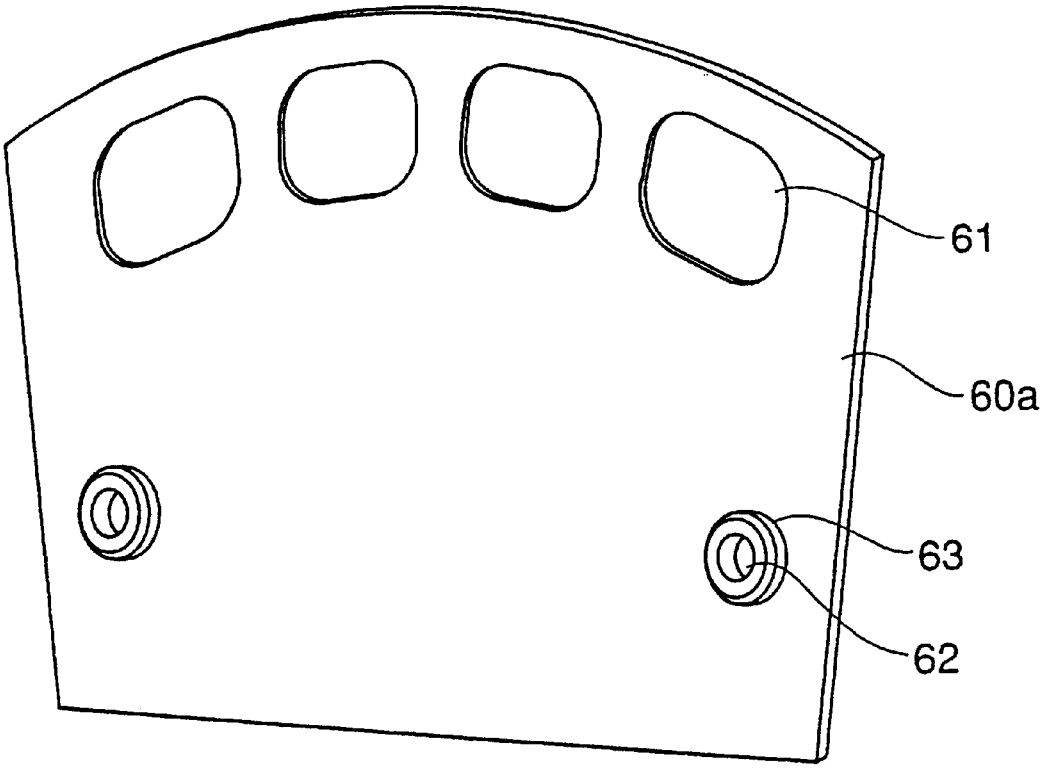
FIG. 7 is a perspective view showing the configuration of a cover plate incorporated in the pickup unit.

A pair of projections 63 is formed in the cover plate 60*a* (see FIG. 7), and the projections 63 are located at side areas of the lower portion of the cover plate 60*a*. The projections 63 are formed with holes 62. Similarly, a pair of projections 63 are formed in the other cover plate 60*b* (see FIG. 3), and holes 62 are formed in the projections 63. The projections 63 are also located at side areas of the lower portion of the cover plate 60*b*. The projections 63 in both cover plates 60*a*/60*b* are insertable into the through-holes 16 formed in the side areas of the lower portion of the core plate 60*c* (see FIG. 4). The through-holes 16 and the projections 63 as a whole constitute a locator. When the cover plates 60*a*/60*b* are assembled with the core plate 60*c*, the projections 63 are inserted into the through-holes 16.

As described hereinbefore, the shallow recesses 61 are formed along the crown edges of the cover plates 60*a*/60*b*, and the shallow recesses 61 in the cover plate 60*a* are respectively paired with the shallow recesses 61 in the other cover plate 60*b*. The shallow recess pairs are associated with the vibration mediators 20. When the cover plates 60*a*/60*b* are assembled with the core plate 60*c* by means of the locator 16/63, the shallow recesses 61 in the cover plate 60*a* are positioned in front of the associated vibration mediators 20, respectively, and the shallow recesses 61 in the other cover plate 60*b* are positioned at the back of the associated vibration mediators 20, respectively.

The visco-elastic bodies 50 penetrate into the pairs of shallow recesses 61. Thus, the vibration mediators 20 are wrapped with the visco-elastic bodies 50, respectively, and the cover plates 60*a*/60*b* are fixed to the core plate 60*c* by means of the visco-elastic bodies 20.

The visco-elastic bodies 50 restrict the amplitude of the vibration mediators 20. As described hereinbefore, the vibration mediators 20 are held in sliding contact with the side surfaces of the lower portions of the finger portions 60*e*. If the visco-elastic bodies 50 were not provided between the vibration mediators 20 and the core plate 60*c*, the vibration mediators 20 would break the bimorph piezoelectric elements 40 due to large-amplitude vibrations of the strings S. The visco-elastic bodies 50 restrict the amplitude of the vibrations of the vibration mediators 20, and prevent the bimorph piezoelectric elements 40 from the damages. Thus, the bimorph piezoelectric elements 40 are sensitive to the small-amplitude vibrations without damage due to the large-amplitude vibrations by virtue of the pieces 42 of plastic substance and visco-elastic bodies 50.

Figure 8:
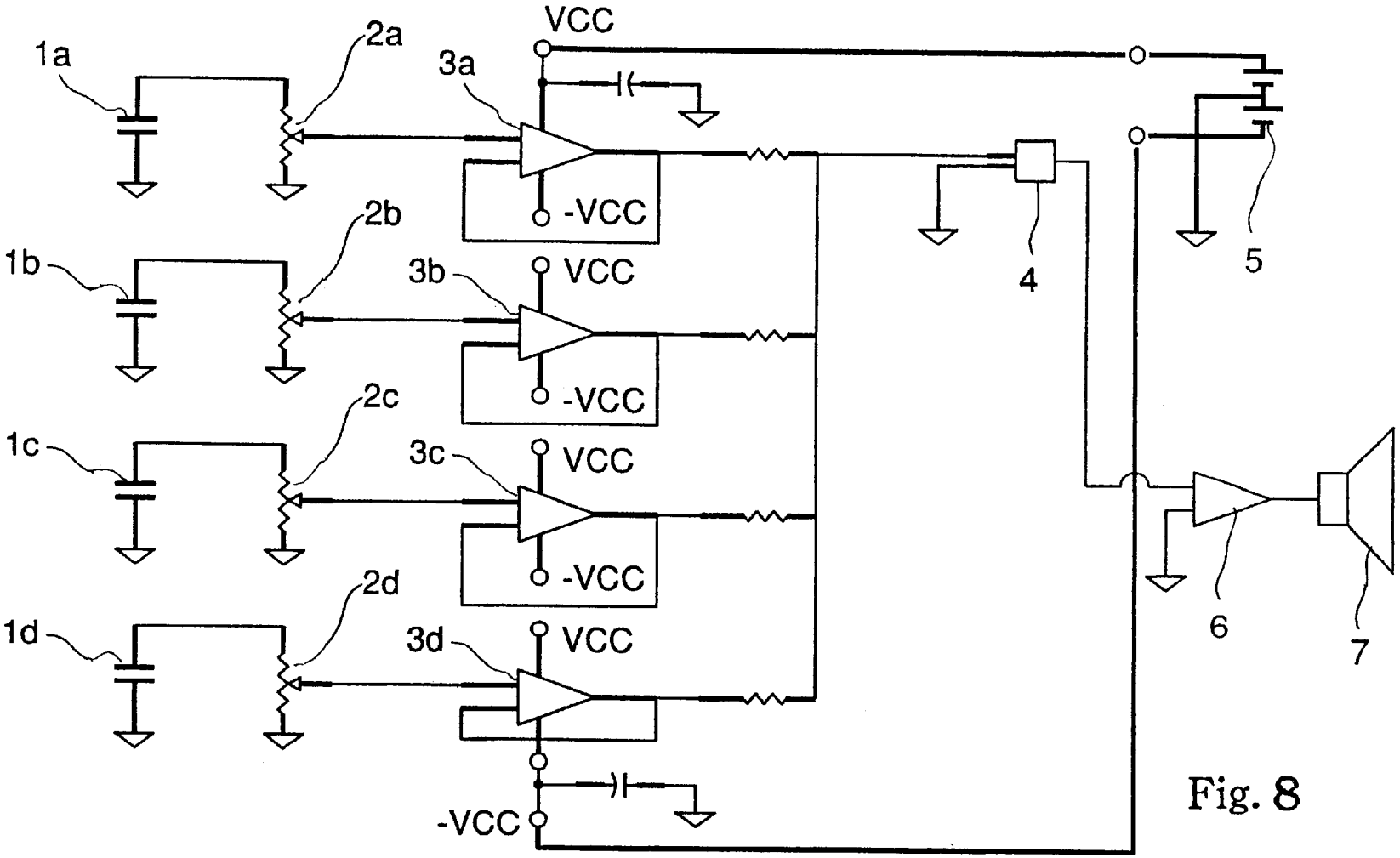
FIG. 8 is a circuit diagram showing the circuit configuration of a sound generating circuit connected to the pickup unit.

Turning to FIG. 8 of the drawings, the vibration-responsive transducer assemblies 30 are incorporated in a sound generating circuit, and are labeled with references 1*a*, 1*b*, 1*c* and 1*d*. The vibration-responsive transducer assemblies 1*a*/1*b*/1*c*/1*d* are connected in parallel to volume controllers 2*a*/2*b*/2*c*/2*d*, which in turn are connected in parallel to buffer amplifiers 3*a*/3*b*/3*c*/3*d*. Power voltage is supplied from a battery 5, and the buffer amplifiers 3*a*/3*b*/3*c*/3*d* independently amplify the electric signals representative of the vibrations in the associated strings S. The buffer amplifiers 3*a*/3*b*/3*c*/3*d* have respective signal output ports, which are connected through a connector 4 to a main amplifier 6. The main amplifier 6 increases the magnitude of the electric signal, and supplies an audio signal to a speaker system 7. Although the vibration-responsive transducer assemblies 1*a*/1*b*/1*c*/1*d* are incorporated in the pickup unit, the other circuit components 2*a* to 2*d*, 3*a* to 3*d*, 4, 5, 6 and 7 are housed in a suitable case physically separated from the pickup unit and the violin. For this reason, the leads 43 are connected through a cable to the volume controllers 2*a*/2*b*/2*c*/2*d*.

A player individually tunes the loudness of the electric tones through the volume controllers 2*a*/2*b*/2*c*/2*d*, and balances the loudness of electric tone produced from the vibrations of each string S with the loudness of other electric tones produced from the vibrations of the other strings S. Thus, even if the vibration-responsive transducer assemblies 1*a*/1*b*/1*c*/1*d* are different in vibration characteristics from one another, the player can cancel the difference from the vibration- responsive transducer assemblies 1*a*/1*b*/1*c*/1*d*.

In case where the difference in vibration characteristics is ignoreable in the vibration-responsive transducer assemblies 1*a*/1*b*/1*c*/1*d*, the volume controllers 2*a*/2*b*/2*c*/2*d* may be deleted from the sound generating circuit. This results in a simple circuit configuration.

When a musician modifies an acoustic violin to the electric violin, he or she replaces the bridge with the pickup unit according to the present invention. The bridge is usually upright on the soundboard B between the f-letter shaped sound holes, and, accordingly, the pickup unit is located at the area occupied by the bridge. The strings S are stretched over the soundboard B, and are respectively engaged with the notches 20*b*. The strings S press the pickup unit to the soundboard B, and make the pickup unit stable on the soundboard B. The leads 43 are connected through a terminal (not shown) to the volume controller 2*a*/2*b*/2*c*/2*d*.

The sound generating circuit is powered on, and the musician starts the bowing. The musician plays a piece of music through the bowing, and gives rise to vibrations of the strings S. The bowed strings S drive the associated vibration mediators 20 for vibrations. The vibration mediators 20 are shaken due to the horizontal components of the vibrations on virtual planes perpendicular to the strings S. The vibration mediators 20 reciprocally slide on the curved side surfaces of the lower portions of the finger portions 60*e*. In other words, the vibration mediators 20 are repeatedly reciprocally rotated about the virtual centers of the curved side surfaces within respective narrow angle ranges. The gap between the vibration mediators 20 and the finger portions 60*e* permit the vibration mediators 20 to repeat the angular motion.

The bimorph piezoelectric elements 40 are fixed at the lower ends thereof to the retainer 30*a*, and the upper ends thereof are restricted by the pieces 42 of plastic substance. In this situation, the vibration mediators 20 repeatedly give rise to bending motion of the bimorph piezoelectric elements 40 through the repeatedly reciprocal rotation. Then, the bimorph piezoelectric elements 40 generate the electric current, and the electric current flows out from the bimorph piezoelectric elements 40 as the electric signals representative of the vibrations of the strings S. The amount of current is varied together with the amplitude of the vibrations. Thus, the vibrations of the strings S are proportionally converted to the electric signals.

The electric signals are processed and amplified before reaching the speaker system 7. The electric signals give rise to vibrations in the speaker system 7, and the electric tones are radiated therefrom.

As will be understood from the foregoing description, the vibration mediators 20 are physically separated from the bridge assembly 10, and are held in sliding contact with the core plate 60*c*. The vibration mediators 20 are vibratory without strong restriction, and give rise to the wide bending motion in the bimorph piezoelectric elements 40. Even if the strings S delicately change the vibrations, the vibration mediators 20 relay the changes to the bimorph piezoelectric elements 40, and the bimorph piezoelectric elements 40 are responsive to the delicate change. For this reason, the players can express his or her delicate emotion through the electric tones. Thus, the pickup unit according to the present invention is more sensitive than the prior art pickup unit disclosed in the U.S. Patent.

Moreover, the visco-elastic bodies 50 restrict the amplitude of the vibration mediators 20 so that the bimorph piezoelectric elements 40 are not damaged.

Second Embodiment

Figure 9:
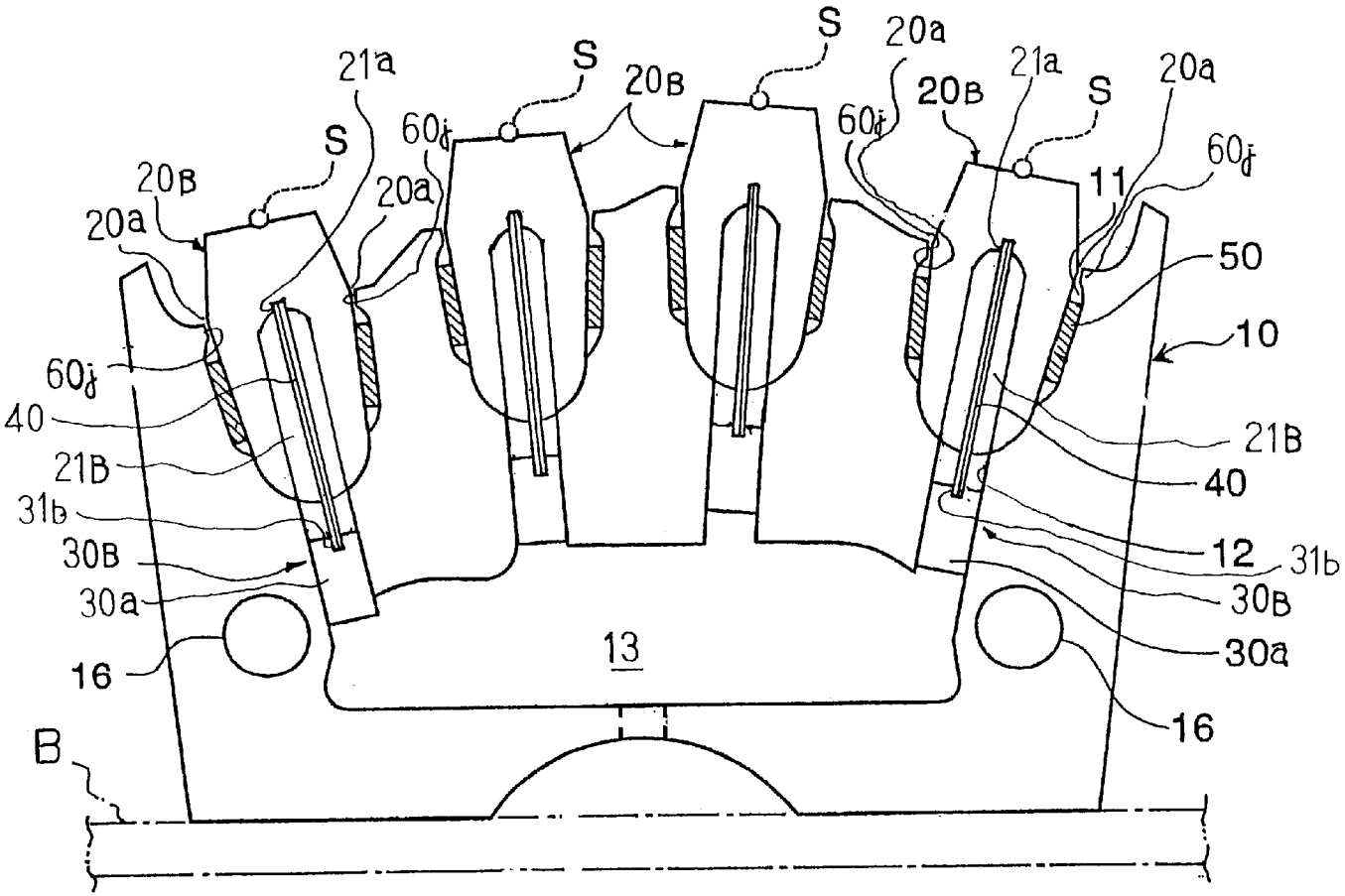
FIG. 9 is a front view showing the structure of another pickup unit according to the present invention.

Turning to FIG. 9 of the drawings, another pickup unit is attached to the sound board B of an electric violin. The pickup unit implementing the second embodiment is similar to the first embodiment except for vibration mediators 20B and vibration-responsive transducer assemblies 30B. For this reason, other component parts are labeled with references designating corresponding component parts of the first embodiment without any detailed description for the sake of simplicity.

Although the vibration mediators 20B are formed with slots 21B, the slots 21B are shallower than the slots 21, and slits 21*a* are formed in the vibration mediators 20B. The slits 21*a* are respectively aligned with the slits 31*b* formed in the retainers 30*a*, and are as narrow as the bimorph piezoelectric elements 40. Each of the bimorph piezoelectric elements 40 are inserted at both end portions thereof to the slits 21*a*/31*b*. The slots 21B are not filled with any pieces of plastic substance.

While the vibration mediators 20B are reciprocally repeatedly being rotated in narrow angle range, the force is exerted on the upper end portions of the bimorph piezoelectric elements 40, and the vibration mediators 20B give rise to the bending motion in the bimorph piezoelectric elements 40. The bimorph piezoelectric elements 40 produce the electric signals representative of the vibrations of the strings. Since the vibration mediators 20B are not restricted, the vibrations are propagated from the strings S to the bimorph piezoelectric elements 40, and the electric signals are improved in fidelity.

The pickup unit implementing the second embodiment achieves all the advantages of the first embodiment.

Third Embodiment

Figure 10:
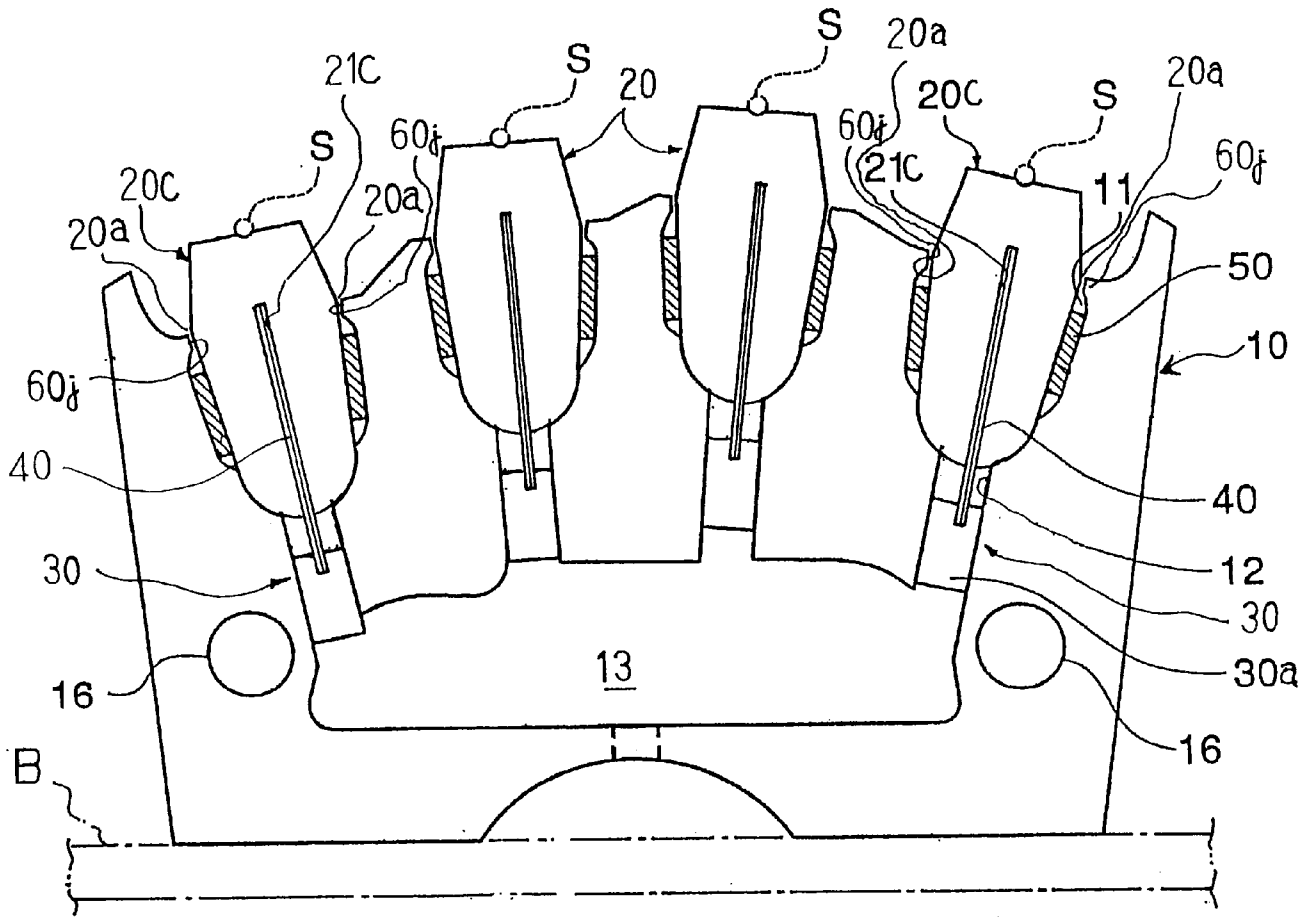
FIG. 10 is a front view showing the structure of yet another pickup unit according to the present invention.

Turning to FIG. 10 of the drawings, yet another pickup unit is attached to the sound board B of an electric violin. The pickup unit implementing the third embodiment is similar to the first embodiment except for vibration mediators 20C. For this reason, other component parts are labeled with references designating corresponding component parts of the first embodiment without any detailed description for the sake of simplicity.

The vibration mediators 20C are formed with slits 21C, which are as thin as the bimorph piezoelectric elements 40, and the bimorph piezoelectric elements 40 are snugly received in the slits 21C. Any piece of plastic substance is not required for between the vibration mediators 20C and the bimorph piezoelectric elements 40 so that the pickup unit is simpler than that of the first embodiment.

While a musician is bowing, the strings S give rise to vibrations of the vibration mediators 20, and the vibration mediators 20 are repeatedly reciprocally rotated in narrow angle ranges. As a result, the bimorph piezoelectric elements 40 are repeatedly bent, and produce electric signals representative of the vibrations of the strings S in good fidelity.

Thus, the pickup unit implementing the third embodiment achieves the advantages of the first embodiment.

Fourth Embodiment

Figure 11:
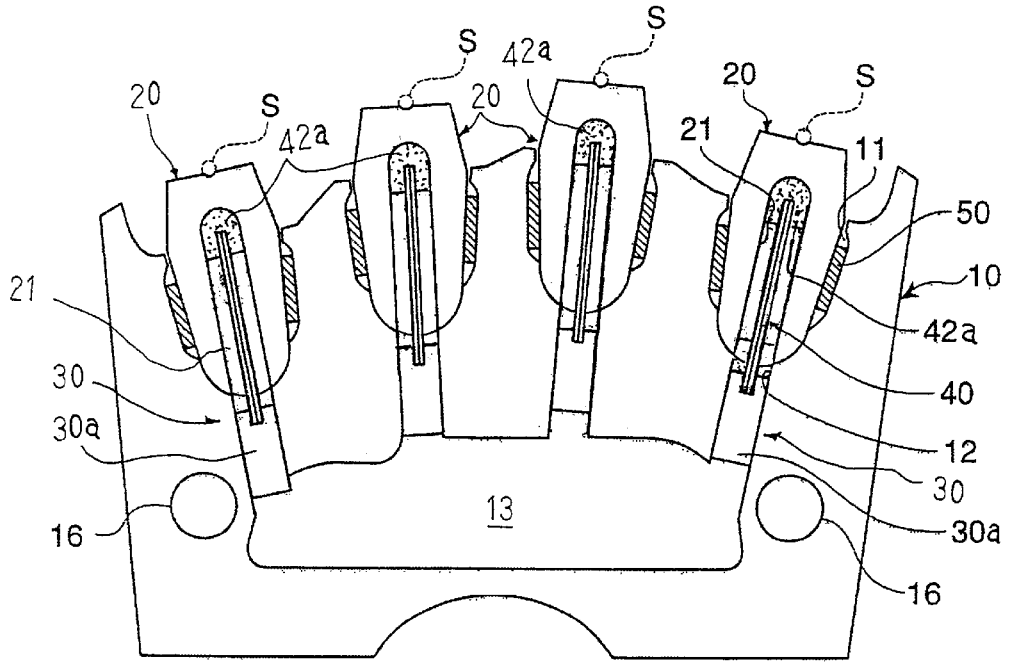
FIG. 11 is a front view showing the structure of still another pickup unit according to the present invention.

Turning to FIG. 11 of the drawings, still another pickup unit is attached to the sound board B of an electric violin. The pickup unit implementing the fourth embodiment is similar to the first embodiment except for pieces 42*a* of plastic substance. For this reason, other component parts are labeled with references designating corresponding component parts of the first embodiment without any detailed description for the sake of simplicity.

The retainers 30*a* are snugly received in the grooves 12, and the bimorph piezoelectric elements 40 are upright on the retainers 30*a* as similar to those of the first embodiment. The vibration mediators 20 are formed with the slots 21, the width of which is much greater than the thickness of the bimorph piezoelectric elements 40. The bimorph piezoelectric elements 40 project into the slots 21, and are spaced from the inner surfaces defining the slots 21. The pieces 42*a* of plastic substance are provided between the leading end portions of the bimorph piezoelectric elements 40 and the vibration mediators 20, and the bimorph piezoelectric elements 40 are exposed to the slots 21 between the pieces 42*a* of plastic substance and the retainers 30*a*.

While the strings S are vibrating, the force is exerted on the leading end portions of the bimorph piezoelectric elements 40 through the pieces 42*a* of plastic substance, and the bimorph piezoelectric elements 40 are repeatedly bent so as to produce the electric signals in good fidelity. Since the pieces 42*a* of plastic substance only restrict the leading end portions of the bimorph piezoelectric elements, the intermediate portions of the bimorph piezoelectric elements 40 are bent without any restriction, and produce the electric signals. Even when the strings S weakly vibrate, the vibration mediators 20 give rise to the bending in the bimorph piezoelectric elements 40, and produce small-amplitude electric signals. Thus, the pickup unit implementing the fourth embodiment is higher in sensitivity than the pickup unit of the first embodiment.

Although the leading end portions of the bimorph piezoelectric elements 40 are embedded in the pieces 42*a* of plastic substance, the pieces 42*a* of plastic substance are not perfectly rigid, and permit the leading end portions to be slightly moved. When the strings S cause the vibration mediators 20 strongly to vibrate, the pieces 42*a* of plastic substance are slightly deformed, and take up part of the vibration energy. Thus, the pieces 42*a* of plastic substance prevent the bimorph piezoelectric elements 40 from breakage due to the strong vibrations.

Fifth Embodiment

Figure 12:
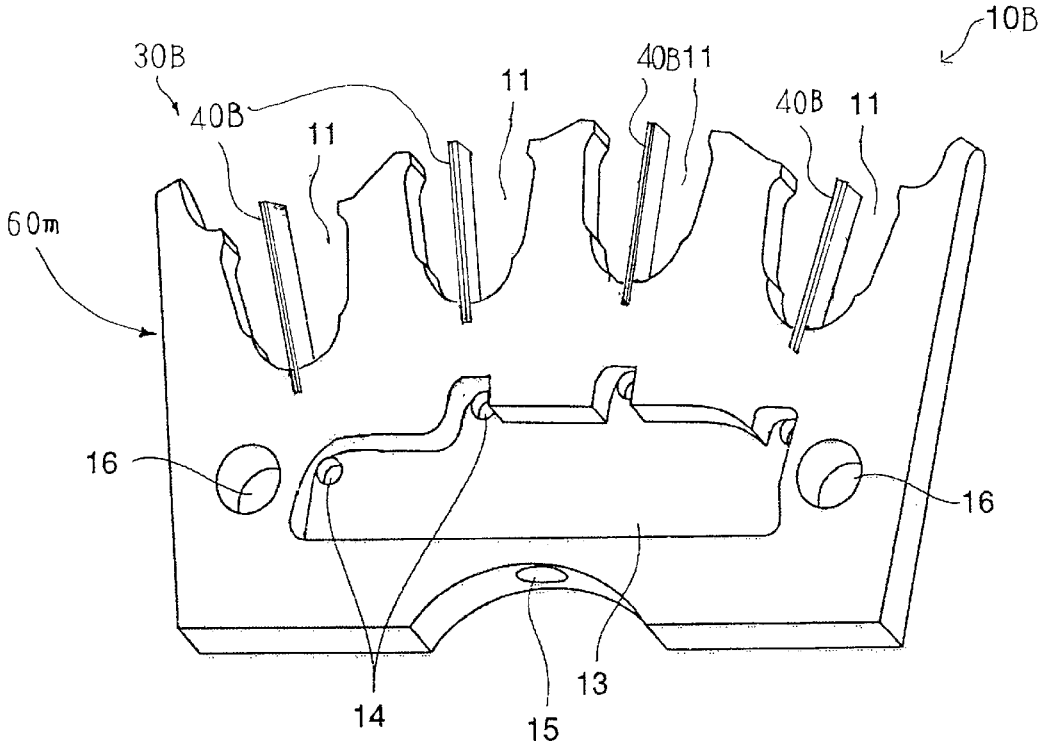
FIG. 12 is a perspective view showing bimorph piezoelectric elements directly supported by a core plate in yet another pickup unit according to the present invention.

Turning to FIG. 12 of the drawings, bimorph piezoelectric elements 40B are directly supported by a core plate 60*m*. The core plate 60*m* is assembled into a bridge assembly 10B together with the cover plates 60*a*/60*b*. Though not shown in FIG. 12, leads are connected to each of the bimorph piezoelectric elements 40B, and the leads and the bimorph piezoelectric element 40B as a whole constitute a vibration-responsive transducer assembly 30B. The vibration-responsive assemblies 30B and the bridge assembly 10B form yet another pickup unit together with the vibration mediators, pieces of plastic substance and visco-elastic bodies. The vibration mediators, pieces of plastic substance and visco-elastic bodies are similar to those of the first embodiment, and no further description is incorporated hereinbelow for avoiding repetition. The core plate 60*m* is formed with the hollow spaces 11, and slits are formed are open to the hollow spaces. The bimorph piezoelectric elements 40B are inserted into the slits, and are directly supported by the core plate 60*m*. For this reason, the retainers are not required for the vibration-responsive transducer assemblies 30B. Thus, the vibration-responsive transducer assemblies 30B are simpler than those of the first embodiment. The pickup unit implementing the fifth embodiment achieves the advantages of the first embodiment.

Sixth Embodiment

Figure 13A:
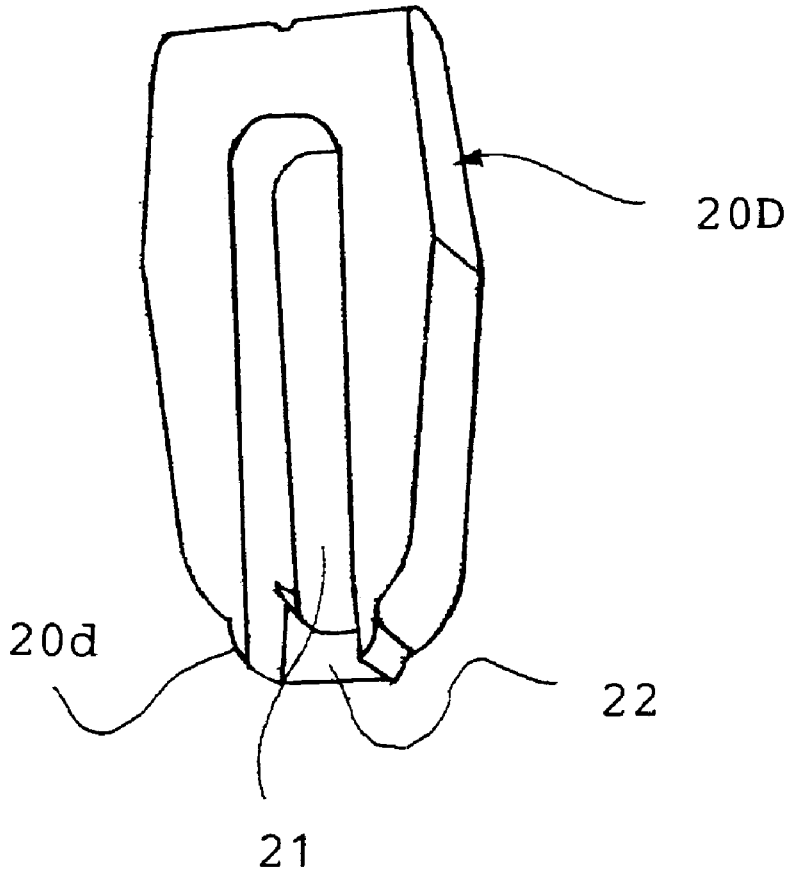
FIG. 13A is a perspective view showing the configuration of another vibration mediator incorporated in the still another pickup unit.

FIG. 13A shows a vibration mediator 20D incorporated in yet another pickup unit implementing the present invention. The other component parts of the pickup unit implementing the sixth embodiment are similar to those of the first embodiment, and no further description is incorporated hereinbelow.

The vibration mediator 20D is different from the vibration mediator 20 in that the lower portion 20*d* is constricted. In the first embodiment, the lower portion of the vibration mediator 20 is in face-to-face contact with the side surfaces of the finger portions 60*e*. On the other hand, the constricted portion 20*d* is held in contact with at the tip thereof with the side surfaces of the finger portions 60*e*. The contact area is drastically reduced by virtue of the constricted portion 20*d*. As a result, the vibration mediator 20D is much liable to slide on the side surfaces of the finger portions 60*e*, and promptly responds to extremely small-amplitude vibrations. Thus, the constricted portion 20*d* makes the pickup unit more sensitive to the vibrations of the strings S.

Figure 13B:
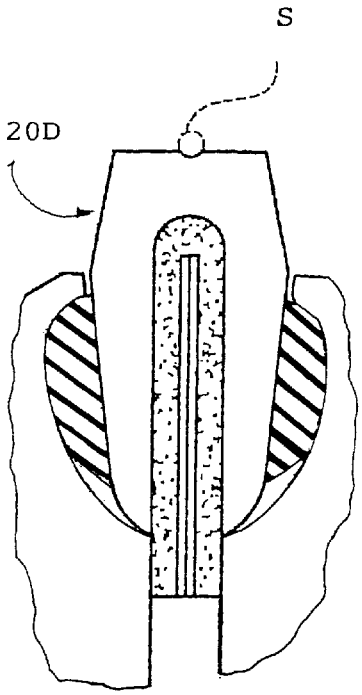
FIGS. 13B and 13C are schematic views showing the configuration of vibration mediators modified on the basis of the vibration mediator shown in FIG. 13A.
Figure 13C:
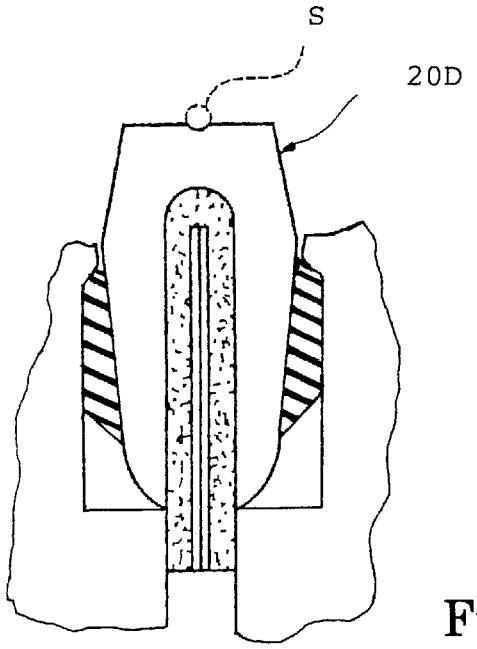
Figure 15:
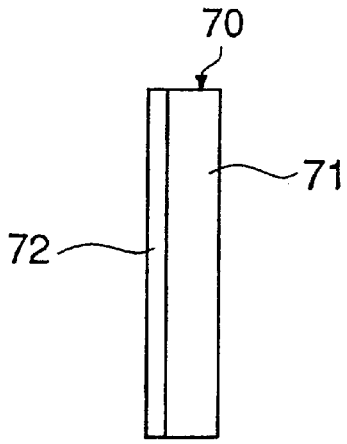
FIG. 15 is a front view showing yet another pickup unit using the monomorph piezoelectric element according to the present invention.

The vibration mediator 20D is designed from the viewpoint that the lower portion 20*d* is permitted to have the radius of curvature different from that of the side surfaces of the finger portions 60*e*. From this point of view, the vibration mediator 20*d* may be modified as shown in FIGS. 13B and 13C.

Seventh Embodiment

Figure 14:
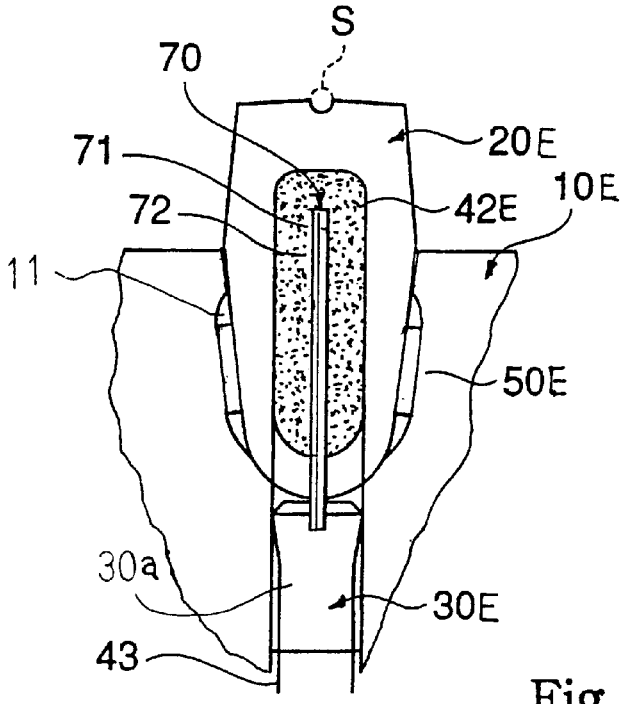
FIG. 14 is a front view showing the structure of a monomorph piezoelectric element.

Turning to FIG. 14 of the drawings, still another pickup unit embodying the present invention comprises a bridge assembly 10E, vibration mediators 20E, vibration-responsive transducer assemblies 30E, pieces 42E of plastic substance and visco-elastic bodies 50E. Although only one vibration-responsive transducer assembly 30E is shown, the bridge assembly 10E has the palm portion and the five finger portions, and each of the hollow spaces 11 is assigned to the vibration-responsive transducer assembly 30E. The bridge assembly 10E, vibration mediators 20E, pieces 42E of plastic substance and visco-elastic bodies 50E are similar in structure to the bridge assembly 10, vibration mediators 20, pieces 42 of plastic substance and visco-elastic bodies 50, and only the vibration-responsive transducer assemblies 30E are different from the vibration-responsive transducer assemblies 30. For this reason, description is focused on the vibration-responsive transducer assembly 30E.

The vibration-responsive transducer assembly 30E comprises the retainer 30*a*, the leads 43 and a monomorph piezoelectric element 70. The monomorph piezoelectric element 70 is adhered to the retainer 30*a*. The monomorph piezoelectric element 70 is a lamination of a piezoelectric plate 71 and a shim 72. The shim 72 is not formed of any piezoelectric crystal. The shim 72 is formed of meal, alloy, carbon, ceramic or synthetic resin. The material for the shim 72 is dependent on a bending moment to be exerted on the piezoelectric plate 71. The monomorph piezoelectric element 70 is much more economical than the bimorph piezoelectric element 40. Thus, the monomorph piezoelectric elements 70 reduce the production cost of the pickup unit. The monomorph piezoelectric elements 70 are commercially obtainable in the market. The monomorph piezoelectric elements may be selected from L-13 series manufactured by TFT Corporation.

The pickup unit implementing the seventh embodiment achieves the advantages of the first embodiment, and is lower in production cost than the pickup units using the bimorph piezoelectric elements.

Eighth Embodiment

Figure 16:
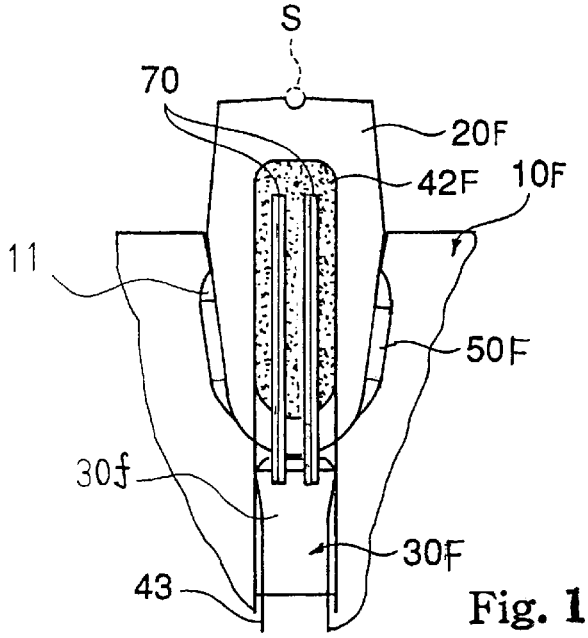
FIG. 16 is a front view showing still another pickup unit according to the present invention.

FIG. 16 shows yet another pickup unit embodying the present invention. The pickup unit comprises a bridge assembly 10F, vibration mediators 20F, vibration-responsive transducer assemblies 30F, pieces 42F of plastic substance and visco-elastic bodies 30F. Although only one vibration-responsive transducer assembly 30F is shown, the bridge assembly 10F has the palm portion and the five finger portions, and each of the hollow spaces 11 is assigned to the vibration-responsive transducer assembly 30F. The bridge assembly 10F, vibration mediators 20F, pieces 42F of plastic substance and visco-elastic bodies 5OF are similar in structure to the bridge assembly 10, vibration mediators 20, pieces 42 of plastic substance and visco-elastic bodies 50, and only the vibration-responsive transducer assemblies 30F are different from the vibration-responsive transducer assemblies 30. For this reason, description is focused on the vibration-responsive transducer assembly 30F.

Vibrations are converted to the electric signal by means of a monomorph piezoelectric transducer 70 as similar to the seventh embodiment. Although only one monomorph piezoelectric element 70 is incorporated in each vibration-responsive transducer assembly 30E, the vibration-responsive transducer assembly 30F includes a pair of monomorph piezoelectric elements 70. Two slits are formed in the retainer 30*f*, and the monomorph piezoelectric elements 70 are bonded to the retainer 30*f* by means of adhesive compound.

The vibration mediator 20F is assumed to exert force on the monomorph piezoelectric elements 70 in a direction indicated by arrow F. The monomorph piezoelectric elements 70 are polarized in either same or opposite direction as indicated by arrow P. There are four combinations of the monomorph piezoelectric elements 70 as shown in FIGS. 17A, 17B, 17C and 17D.

Figure 17A:
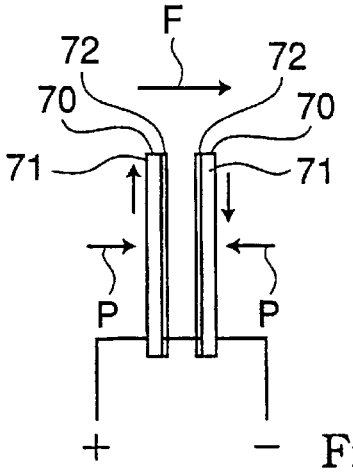
FIGS. 17A to 17D are schematic views showing variations of the twin monomorph piezoelectric elements.
Figure 17B:
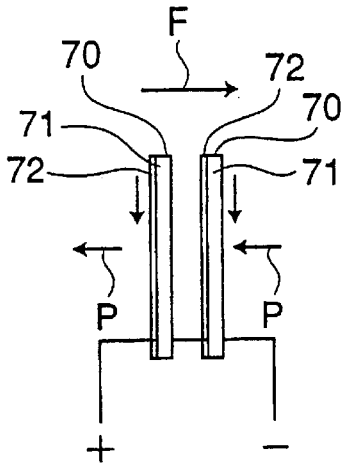
Figure 17C:
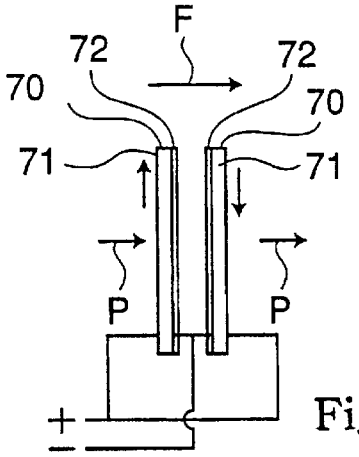
Figure 17D:
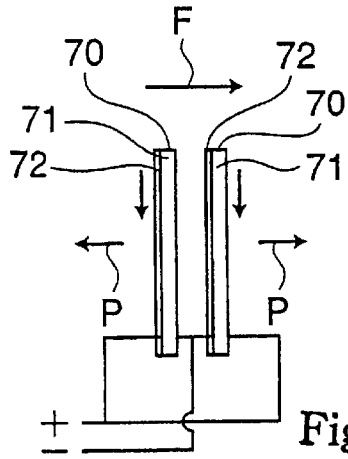

When the force F is exerted on the monomorph piezoelectric elements 70, the monomorph piezoelectric elements 70 are elongated in the opposite directions as indicated by vertical arrows (see FIGS. 17A and 17C), or in the same direction (see FIGS. 17B and 17D). In order to permit the electric current to flow through the monomorph piezoelectric elements 70, the positive power line (+) and the negative or ground line are to be connected as shown.

The monomorph piezoelectric elements 70 are independent of each other, and, accordingly, deformed differently. In other words, the amount of bending stress in one of the monomorph piezoelectric element 70 is different from the amount of bending stress in the other monomorph piezoelectric element 70. This results in difference in electromotive force between the monomorph piezoelectric elements 70. This tendency is clearly observed when the magnitude of the force or the direction of the force is changed. In other words, the pickup unit with the pairs of monomorph piezoelectric elements 70 delicately varies the electric signals. The pickup unit with the pairs of bimorph piezoelectric elements 40 exhibits the same vibration-to-current characteristics. Thus, the pickup unit with the plural piezoelectric elements is preferable for senior players, who delicately bow the strings S.

As will be appreciated from the foregoing description, the pickup unit according to the present invention includes the stationary member, i.e., core plate and the vibratory members, i.e., the vibration mediators not restricted in the direction of the deformation of the vibration-responsive transducer. The vibration-responsive transducer is connected to both of the stationary member and the associated vibration mediator. While the strings are driving the vibration mediators for vibrations, the vibration mediators give rise to the deformation in the associated vibration-responsive transducers, and the electric signals representative of the vibrations are output from the vibration-responsive transducers. The vibration mediators freely vibrate with respect to the stationary member, and the vibrations of the mediators are well equivalent to the vibrations of the strings. As a result, the vibration-responsive transducers produce the electric signals in good fidelity.

Although particular embodiments of the present invention have been shown and described, it will be apparent to those skilled in the art that various changes and modifications may be made without departing from the spirit and scope of the present invention.

First of all, the pickup unit according to the present invention is available for not only the other stringed instrument of the violin family but also another kind of stringed instrument such as, for example, guitars.

The cover plates 60*a*/60*b* may be deleted from the bridge assembly 10. In this instance, only core plate 60*c* is upright on the body of a stringed musical instrument. The pickup unit without any cover plates is simple, and is reduced in production cost.

The electric stringed musical instrument may have a solid body. The solid body does not have any resonator. Strings are stretched over the solid body, and are engaged with the vibration mediators. The vibrations of the strings are converted to the electric tones through a suitable sound generating circuit. The visco-elastic bodies 50 may be replaced with springs. In this instance, the strings are inserted between the side surfaces of the finger portions 60*e* and the vibration mediators 20. The cover plates 60*a*/60*b* are secured to the core plate 60*c* by means of a suitable coupling means such as, for example, bolts and nuts.

Another circuit element such as, for example, a filter circuit may be incorporated in the sound generating circuit. The volume controllers 2*a*/2*b*/2*c*/2*d* may be built in an electric violin. In this instance, the volume controllers 2*a*/2*b*/2*c*/2*d* are connected through a cable to the buffer amplifiers 3*a*/3*b*/3*c*/3*d*, which are housed in a case together with the connector 4, battery 5, main amplifier 6 and speaker system 7.

The sound generating circuit may be incorporated in an electric stringed musical instrument. The circuit components 2*a*–2*d*, 3*a*–3*d*, 4 and 6 may be integrated on a small circuit board connected to the battery 5, the vibration-responsive transducers 1*a* to 1*d* and the speaker 7 through cables, and the circuit board, the battery 5 and the speaker 7 are housed in the body or embedded in it. The electric stringed musical instrument is enhanced in port-ability.

Although the slits 21*a* are formed in the vibration mediators 21B, it is not easy to form the slits 21*a* in the slots 21B. Instead, the bimorph piezoelectric elements 40 may be bonded to the bottom surfaces of the vibration mediators 21B by means of pieces of adhesive compound.

Vibration mediators may have the freedom to move in a certain direction or directions only. The certain direction or directions are dependent on the direction of sensitivity in the vibration-responsive transducer. The bimorph piezoelectric element is responsive to the force exerted thereon in the direction parallel to the thickness thereof for generating the electric signal. In this instance, the vibration mediator is never restricted along the side surfaces of the finger portions 60*e*. However, even if the vibration mediator is restricted in a direction perpendicular to the virtual plane where the vibration mediator is moved, the restriction does not have any influence on the vibration-responsive transducer.

The vibration mediators may be anchored to the side surfaces of the associated finger portions. For example, the lower portion of a vibration mediator may be bonded to the side surfaces of the associated finger portions by means of a piece of adhesive compound. When the string S gives rise to vibrations of the vibration mediator, the piece of adhesive compound is resiliently deformed so as to permit the vibration mediator to bend the piezoelectric element. The vibration mediator thus anchored is in the technical scope of the present invention.

A vibration mediator per se may have resiliency. The dimensions and resilient material are to be selected in such a manner that the resilient vibration mediator can vary the pressure on the associated vibration-responsive transducer in the detectable range of the transducer in spite of the vibrations generated therein. In this instance, even if the resilient vibration mediator is fixed to the side surfaces of the finger portions, the vibrating string S gives rise to vibrations in the resilient vibration mediator, and the vibration-responsive transducer converts the vibrations to an electric signal.

Each of the vibration mediators may be associated with more than one bimorph piezoelectric element. A large mount of current is generated in the plural bimorph piezoelectric elements, and the signal is swung in a wide range.

Any kind of vibration-responsive transducer is available for the pickup unit in so far as it converts the difference in relative position between the vibration mediator and the core plate to an electric signal. Examples of the other vibration-responsive transducer are, by way of example, strain gauges and magnetostrictive transducers.

The vibration mediators may impart sharing force or twisting to the vibration-responsive transducer assemblies.

What is claimed is:

1. A pickup unit for a stringed musical instrument, comprising:

a stationary member attached to a body of said stringed musical instrument, and having plural zones;

plural transducers connected at certain portions thereof to said stationary member in said plural zones, respectively, and deformable in response to repeated forces respectively exerted thereon in certain directions for producing electric signals representative of said repeated forces; and plural vibration mediators connected between strings of said stringed musical instrument and other portions of said plural transducers for transmitting said repeated forces from said strings to said plural transducers, and having a freedom to move in at least said certain direction in said plural zones, respectively.

2. The pickup unit as set forth in claim 1, in which said plural transducers respectively have piezoelectric elements so as to produce said electric signals when said plural transducers are deformed.

3. The pickup unit as set forth in claim 2, in which said piezoelectric elements are responsive to said repeated forces so as to produce said electric signals through repetition of bending.

4. The pickup unit as set forth in claim 3, in which said piezoelectric elements are of a bimorph type having two piezoelectric crystal plates.

5. The pickup unit as set forth in claim 4, in which each of said piezoelectric elements has a single pair of bimorph-type piezoelectric crystal plates.

6. The pickup unit as set forth in claim 4, in which each of said piezoelectric elements has plural pairs of bimorph-type piezoelectric crystal plates.

7. The pickup unit as set forth in claim 3, further comprising pieces of plastic substance provided between said plural vibration mediators and said piezoelectric elements for propagating said repeated forces over said plural transducers.

8. The pickup unit as set forth in claim 3, further comprising visco-elastic bodies provided between said stationary member and said plural vibration mediators so as to restrict said plural vibration mediators.

9. The pickup unit as set forth in claim 3, in which said piezoelectric elements are of a monomorph type having a single piezoelectric crystal plate.

10. The pickup unit as set forth in claim 9, in which each of said piezoelectric elements has a single monomorph-type piezoelectric crystal plate.

11. The pickup unit as set forth in claim 9, in which each of said piezoelectric elements has plural monomorph-type piezoelectric crystal plates.

12. The pickup unit as set forth in claim 1, in which said plural vibration mediators have respective slots closed at first ends thereof and open at second ends thereof on contact surfaces so that said plural transducers project through said second ends into said slots, respectively.

13. The pickup unit as set forth in claim 12, in which said slots have a width greater than a thickness of said plural transducers so that said plural transducers have intermediate portions spaced from inner surfaces defining said slots.

14. The pickup unit as set forth in claim 12, in which said plural transducers have tip portions fixed to said plural vibration mediators, respectively.

15. The pickup unit as set forth in claim 12, in which said plural transducers have tip portions spaced from said inner surface, and said tip portions are connected to said inner surfaces by means of pieces of plastic substance.

16. The pickup unit as set forth in claim 13, in which said pieces of plastic substance further fill the spaces between remaining portions of said plural transducers and said inner surfaces.

17. The pickup unit as set forth in claim 12, in which said plural vibration mediators further have respective connecting bars for reinforcing said second ends.

18. The pickup unit as set forth in claim 1, in which said plural transducers have respective retainers snugly received in grooves formed in said stationary member and respective force-to-electric current converting portions projecting from the associated retainers.

19. The pickup unit as set forth in claim 18, in which said force-to-electric current converting portions project into slots formed in said plural vibration mediators, respectively, and are connected to the associated plural vibration mediators.

20. The pickup unit as set forth in claim 19, further comprising pieces of plastic substance provided between said force-to-electric current converting portions and inner surfaces of said plural vibration mediators defining said slots.

21. The pickup unit as set forth in claim 1, in which said plural transducers have respective force-to-electric current converting portions directly secured to said stationary member at intervals, and are connected to the associated plural vibration mediators.

22. The pickup unit as set forth in claim 21, further comprising pieces of plastic substance provided between said force-to-electric current converting portions and inner surfaces of said plural vibration mediators defining said slots.

23. The pickup unit as set forth in claim 1, in which said stationary member have curved surfaces defining parts of boundaries of said zones, and said plural vibration mediators have respective curved contact surfaces held in face-to-face contact with said curved surfaces of said stationary member so that said curved contact surfaces slid on said curved surfaces when said repeated forces are exerted on said plural vibration mediators.

24. The pickup unit as set forth in claim 23, in which said curved surfaces have a radius of curvature measured from a virtual center thereto so that said vibration mediators are driven for reciprocal angular motion about said virtual center.

25. The pickup unit as set forth in claim 1, in which said stationary member have curved surfaces defining parts of boundaries of said zones, and said plural vibration mediators have respective projections substantially held in point-to-surface contact with said curved surfaces so that said projections slid on said curved surfaces when said repeated forces are exerted on said plural vibration mediators.

26. The pickup unit as set forth in claim 1, further comprising pieces of plastic substance provided between said plural vibration mediators and said plural transducers, respectively.

27. The pickup unit as set forth in claim 26, in which said pieces of plastic substances are held in contact with tip portions of said plural transducers, and remaining portions of said plural transducers are uncovered with said pieces of plastic substance.

28. The pickup unit as set forth in claim 26, in which said pieces of plastic substances are held in contact with force-to-electric current converting portions of said plural transducers.

29. The pickup unit as set forth in claim 26, in which said pieces of plastic substance have a hardness ranging from 4.0 to 4.5 under the conditions that a steel ball of 36 millimeter in diameter and 200 grams in weight is dropped to the piece of substance over 50 centimeters high for forming a dent in said piece of plastic substance and that said hardness is varied by 0.1 from 3 when said dent is varied from 28 millimeter in diameter by 0.5 millimeter.

30. The pickup unit as set forth in claim 29, in which said plastic substance is fat clay.

31. The pickup unit as set forth in claim 1, further comprising visco-elastic bodies provided between said stationary member and said plural vibration mediators so as to restrict the motion of said vibration mediators when said repeated forces are exerted on said plural vibration mediators.

32. The pickup unit as set forth in claim 31, in which said visco-elastic bodies are formed of silicone sealer.

* * * * *